United States Patent [19]

Shultz et al.

[11] 4,407,319

[45] Oct. 4, 1983

[54] WIND SHELTER

[76] Inventors: George W. Shultz; Nouelle A. Shultz, both of P.O. Box 611 (431 N. Canyon), Camino, Calif. 95709

[21] Appl. No.: 323,973

[22] Filed: Nov. 23, 1981

[51] Int. Cl.[3] ..... A45F 1/00; E04F 10/04

[52] U.S. Cl. ..... 135/87; 160/352; 135/904

[58] Field of Search ..... 135/1 R, 4 R, 2, 5.1, 135/5 B, 5 R, 14 R, 16, 4 B, 117, 87, 900–903, 904; 160/352, 90–92; 52/631, 71; 47/26, 29–31; 256/19, 24; 206/315 R

[56] References Cited

U.S. PATENT DOCUMENTS

| | | | |
|---|---|---|---|
| 2,619,101 | 11/1952 | McGerry et al. | 135/4 R |
| 2,997,277 | 8/1961 | Schwartz | 135/5 R |
| 3,070,107 | 12/1962 | Beatty | 135/5 R |
| 3,958,385 | 5/1976 | Bondra et al. | 52/631 |
| 4,023,582 | 5/1977 | Buzzella et al. | 52/82 |

*Primary Examiner*—Richard C. Pinkham
*Assistant Examiner*—Stephen R. Crow
*Attorney, Agent, or Firm*—Bruce L. Birchard

[57] ABSTRACT

A wind shelter device having flexible frame and pane portions which are supported upright by a plurality of detachable ballast containers. Included is a storage tube for receiving the shelter having the ballast containers acting as end caps for the tube.

1 Claim, 17 Drawing Figures

WIND SHELTER

BACKGROUND OF THE INVENTION

1. Field of the Invention

This invention relates to wind shelters and more specifically to wind shelters for use at the beach or in similar environments.

2. Prior Art

A search of pertinent sub-classes in the United States Patent and Trademark Office has disclosed the following patents which relate to, but do not anticipate, the present invention.

U.S. Pat. No. 2,997,277 (Schwartz) issued Aug. 22, 1961 fails to show a beach shelter with detachable ballast containers, as this invention discloses. Schwartz relies upon pointed posts 13 which must be pounded into the earth at the sites where the shelter is to be used. The site may be rocky, for example, making the construction of the Schwartz shelter difficult. This inventor's removable ballast containers provide stability for the shelter despite the nature of the surface at the point where the shelter is to be used. Thus, applicant's shelter might be used equally well at the beach or at an ice-fishing site. Such can not be said for the device of Schwartz.

U.S. Pat. No. 2,981,256 (Besnah), issued Apr. 25, 1961, fails to show or suggest a detachable ballast container as shown and claimed by applicant. Elements 62 and 71 in Besnah are described as "feet" and element 66 as a "pad." There is no contemplation of providing a ballast container, as claimed by applicant. The Besnah device would have limited stability in anything resembling a strong breeze. Applicant's device would be stable under very strong wind conditions. It would be simply a matter of loading the ballast containers sufficiently.

U.S. Pat. No. 3,537,687 (Adelman), issued Nov. 3, 1970 is not directed to a shelter, it merely shows a wall structure of convenient configuration but one which does not contemplate the use of detachable ballast containers, as claimed by applicant. Adelman contemplates permanent attachment to the soil (100) by pounding reinforcing rods into the ground (Col. 9, lines 36–38).

U.S. Pat. No. 3,835,602 (Tuuri), issued Sept. 17, 1974, fails to show or suggest the detachable ballast containers shown and claimed by applicant. Tuuri appears to rely on the weight of his structure, alone, to provide stability. It would not be truly portable.

U.S. Pat. No. 3,889,698 (Roessl), issued June 17, 1975, describes a portable but heavy, bulky, shelter which is collapsible but there is no mention of how the shelter is secured to the surface on which it is placed. There is no suggestion of applicant's novel structure in which detachable ballasts are provided to give the structure stability. There also is no suggestion of a method for intercoupling, removably, a central umbrella section, with the wall of the shelter.

U.S. Pat. No. 3,996,706 (Bomgaars), issued Dec. 14, 1976 is directed to a special link for coupling the roof portion to the wall portion, and the wall portion to the ground. There is no suggestion of the use of detachable ballast containers. In fact, at column 4, lines 16 to 21 reference is made to a stake 44 to secure this complicated structure to the ground.

Therefore, it is an object of this invention to provide an improved wind shelter which is stable on any surface and is portable, light-weight, compact, may be transparent for viewing, is easy to assemble, and is inexpensive.

SUMMARY OF THE INVENTION

Stated succinctly, a light-weight, low-cost, collapsible, portable, effective and highly stable wind shelter is realized by providing on the shelter itself connectors for receiving, detachably, ballast containers which may be loaded with an appropriate amount of ballast material, such as sand, rock or ice, to make the structure stable in the presence of wind of relatively high velocity. Further, by intercoupling the ends of a central umbrella portion's fabric supporting elements and the upper portions of the shelter's wall member or members, additional rigidity and, of course, wind sheltering, is realized.

BRIEF DESCRIPTION OF THE DRAWINGS

This invention both as to its objectives and the means by which those objectives are achieved, can best be understood by the description which follows taken in connection with the drawings herein, in which:

FIG. 1B is a top view of the embodiment of FIG. 1 with an added element;

DETAILED DESCRIPTION OF THE PREFERRED EMBODIMENTS

Figure 1:
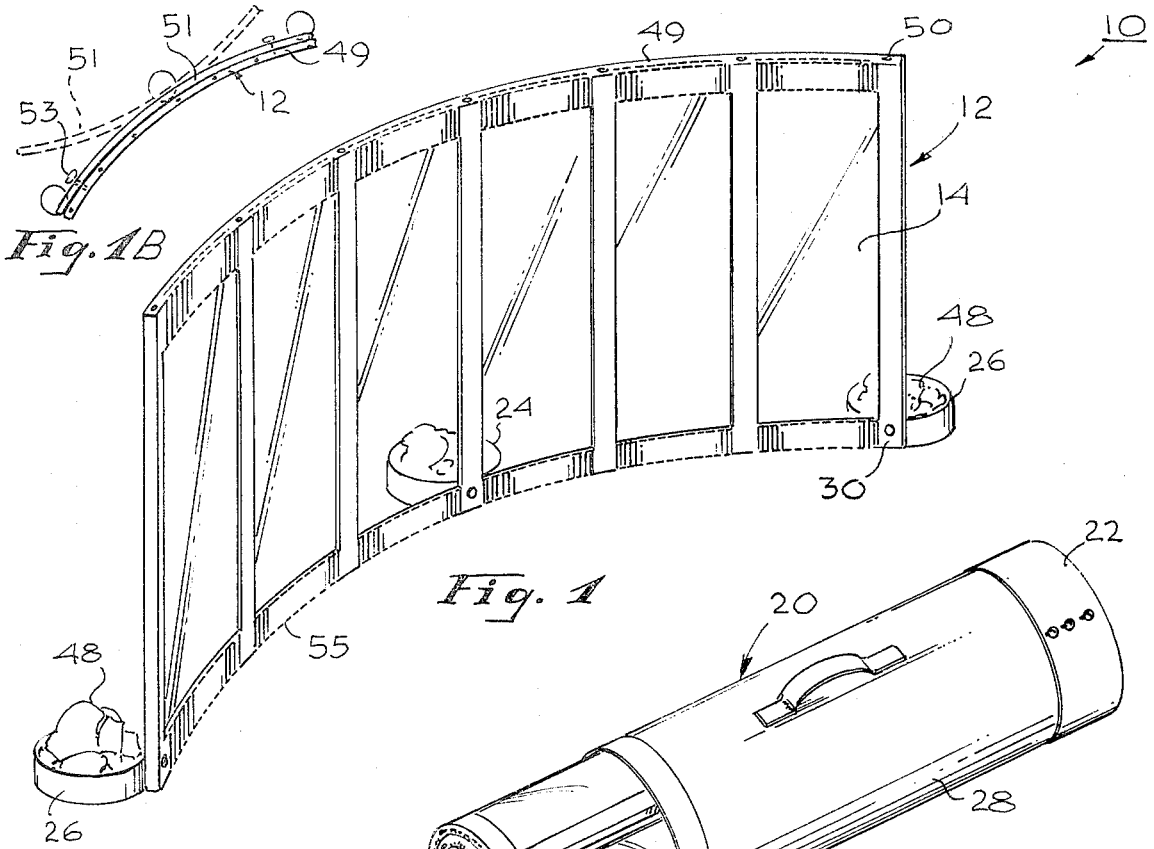
FIG. 1 is an elevational view of one embodiment of my invention.

In FIG. 1 wind shield 10 comprises a frame portion 12 and a panel portion 14 of lesser thickness than frame portion 12. Panel portion 14 may be formed integrally with frame 12 by plastic casting techniques or panel 14 may be applied in a second step to frame portion 12.

Figure 2:
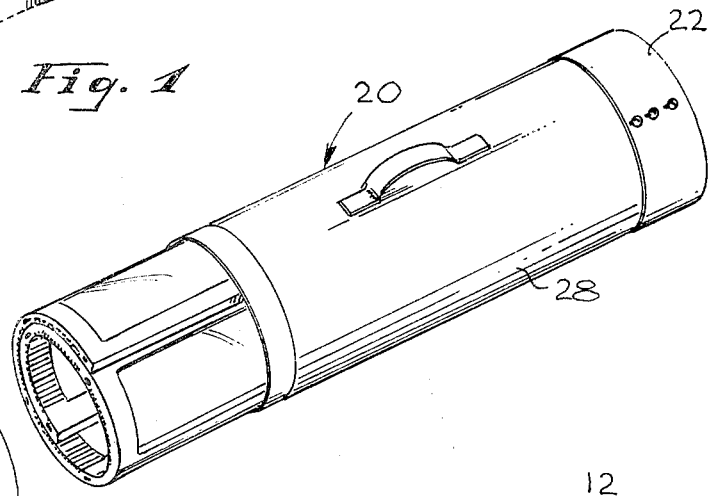
FIG. 2 is a partially exploded view of a wind shelter, according to my invention, collapsed and in a container for easy transportation.
Figure 2:
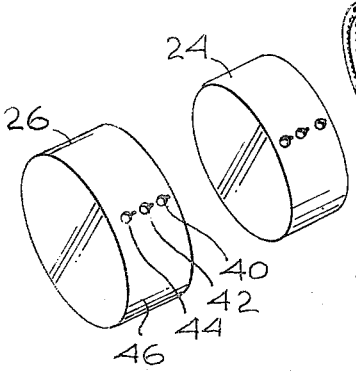
Figure 1A:
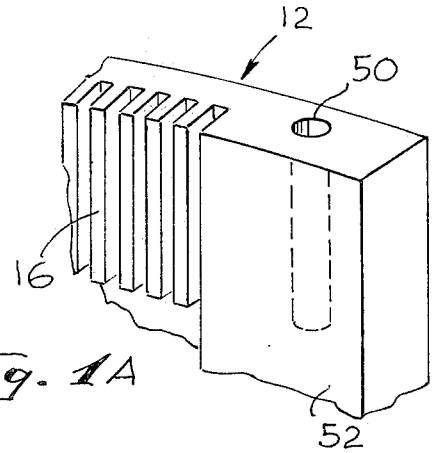
FIG. 1A is an enlarged view of a portion of the structure shown in FIG. 1.

As shown in FIG. 1A, the upper and lower edges of frame portion 12 are serrated, as at 16, to retain rigidity of the frame structure while permitting it to be rolled for placement in a carrying case 20, as shown in FIG. 2. Rolling may produce some permanent tendency of upper edge 49 to curl out of the configuration of lower edge 55 unless edge 49 is other restrained. Such restraint, or counter-bias, can be achieved by the technique shown in FIG. 1B. In FIG. 1B edge 49 has secured thereto by buttons 53 (which may be formed integrally with upper edge 49) biasing strip 51 which may be of plastic or metal but has a preset bias in the opposite direction from that in which upper edge 49 tends to curl and has a spring factor K substantially equal to that exhibited by upper edge 49, thus biasing upper edge 49 to a shape corresponding to that of lower edge 55. Curling of upper edge 49 is thus prevented. Strip 51 may be coiled and stored in one of the end caps of case 20. Container 20, as shown in FIG. 2, has three end caps 22, 24 and 26. End cap 24 is nested within end cap 26 and the two are applied to one end of tubular portion 28 of container 20. The remaining end cap 22 may be a unitary structure or may contain a nested cap, not shown on strip 51. End caps 22, 24 and 26 attach to protruding buttons on the outer face of wind shelter 10. The location of the securing buttons can be determined from the opposite ends of those buttons shown in FIG. 1 at, for example, point 30. The configuration of the button is the same as that of the button shown in FIG. 6A.

Figure 3:
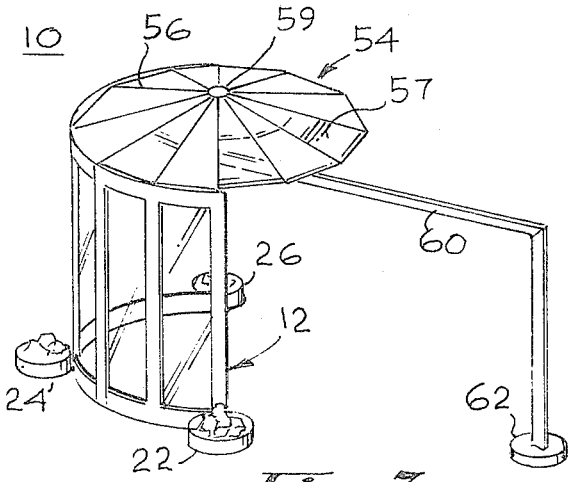
FIG. 3 is a schematic representation of a modification of the wind shelter according to my invention.
Figure 3A:
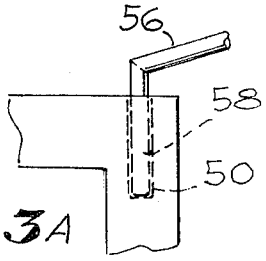
FIG. 3A is an enlarged view of a portion of the structure of FIG. 3 showing the inter-connection between a central umbrella portion and the main wind shelter walls, according to my invention.

As can be seen from FIG. 2, end caps 22, 24 and 26 have multiple apertures in the side walls thereof. For example, cap 26 has apertures 40, 42 and 44 in the side wall 46, thereof. The different positions of the apertures permits placing wind shield 10 on a uneven surface and adjusting the position of the ballast containers, which end caps 22, 24 and 26 become to fit the particular terrain. This assures a stable wind shield structure. The end caps, turned ballast containers, are filled with dirt or rocks 48 to assure stability for the structure. They may be buried for stability. The receptacle 50 in frame member 52 shown in FIG. 1A is provided for the purpose of receiving respective ones of the tips of the support elements making up the upper portion of an umbrella. The combination can be seen more clearly in FIG. 3 in which wind shield 10 has added to it umbrella 54 which has an upper portion 55 comprising a fabric 57 supported on umbrella stays or elements 56. The entire upper portion 55 is supported by means of a stand 60 which has its own base 62 properly provided with ballast to give the umbrella portion 54 stability. As can be seen from FIG. 3A, the tips 58 of individual stays or elements 56 are inserted in receptacle 50 to unitize the combination of the umbrella 54 and the wind shield 10, thus giving increased stability and freedom from undesired wind blasts and currents. The umbrella fabric may be secured to the wind shield 10 with snaps or grommets. As can be seen from FIGS. 1 thru 3 the wind shield, according to this invention, can be easily transported in its collapsed condition, namely, when the wind shield is rolled as shown in FIG. 2, the ballast containers being detachable from the wind shield and forming the end closures or end caps for the tube 28.

Figure 4:
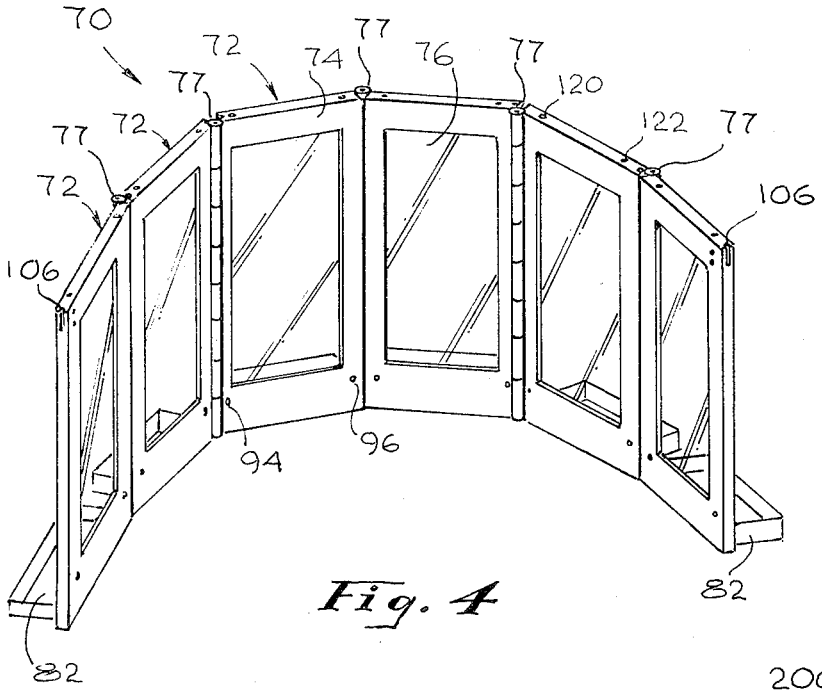
FIG. 4 is an elevational view of an alternative form of wind shelter, according to my invention.

The wind shield 70 of FIG. 4 is formed from flat panels 72. These flat panels have a frame portion 74 which may be of reinforced plastic or aluminum. Each flat panel has a plastic pane 76, therein, and is joined to the adjacent panel by a piano-type hinge 77. Except where the wind shield 70 is to be used as a cabana for dressing, panes 76 are transparent for easy viewing of the ocean or the other environment in which the wind shield is being used. The panels may have detachable ballast containers 82 associated therewith. The nature of the ballast containers 82 and their attachment to associated panels can best be seen from FIG. 5.

Figure 6A:
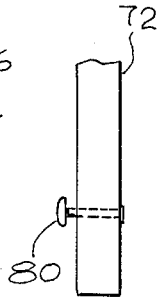
FIG. 6A is a side view of a portion of the structure of FIG. 6.
Figure 6:
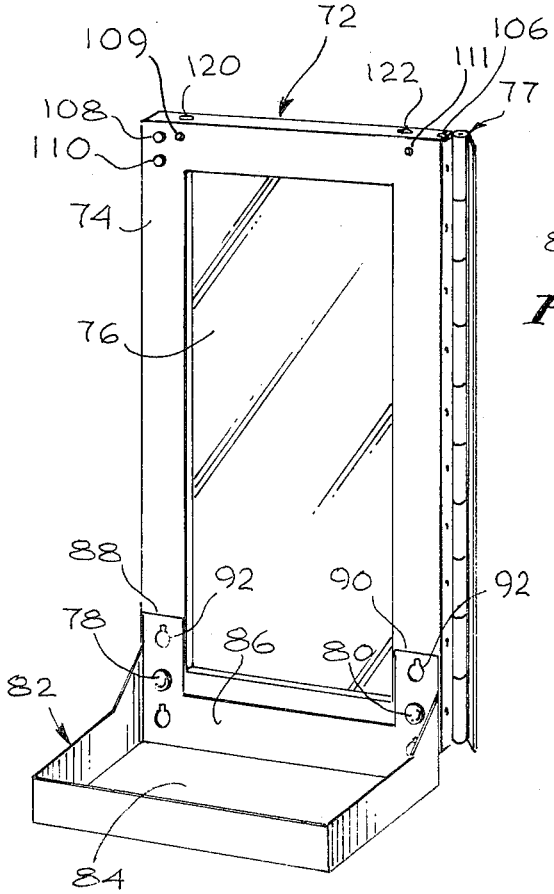
FIG. 6 is an enlarged view of a single panel taken from the wind structure shelter of FIG. 4, showing certain details of a detachable ballast container.

In FIG. 6 panel 72 has buttons 78 and 80 supported rigidly therein, as can be seen more clearly in FIG. 6A. The ballast container 82 has a base portion 84 adapted to receive rocks or sand for ballast purposes. Ballast container 82 also includes a back portion 86 having two upright end pieces 88 and 90, each of these upright portions 88 and 90 having a plurality of apertures 92 therein at differing elevations, such apertures being adapted to engage and cooperate with buttons 78 and 80 to secure the ballast container 82 to the outer surface of panel 72. The ends of buttons 78 and 80 on the inner side of panel 72 are shown as elements 94 and 96 in FIG. 4. Ballast container 82 is filled with 10 to 15 pounds of stones or sand to provide stability to each panel 72 and, consequently, to the entire wind shield 70. These ballast containers may also be buried in sand or dirt.

Figure 5A:
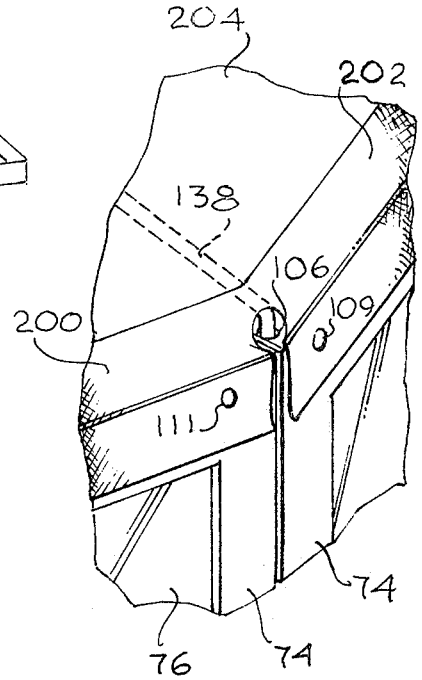
FIG. 5A is an enlarged view of a portion of the structure of FIG. 5.
Figure 5:
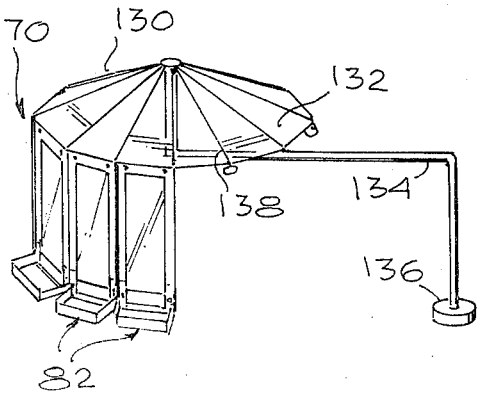
FIG. 5 shows an elaboration upon the wind shelter structure of FIG. 4.

Female receptacles 120 and 122 shown in FIG. 5 are provided to permit stacking of panels to form a wind shield of greater height as will be described more fully hereinafter.

In FIG. 5, the wind shield of FIG. 4 has been augmented by an umbrella 130 which has a fabric covered shelter portion 132 and a support pole 134 which itself is supported in a ballast 136. The inter-connection between stays 138 of shelter portion 130 and panel 72 in wind shield 70 is in a fashion similar to that described in connection with FIG. 3. It is to be recalled that, as shown in FIGS. 6 and 6A, receptacles 106 are provided in each of the panels 72 or in end pieces 112 (at 118) in FIG. 7 to receive the tips of the supporting elements or stays 138.

FIG 5A shows how flaps 200 and 202, which are extensions of umbrella covering fabric 204, are coupled by way of buttons 111 to frame 74 of each panel 72 to form an effective wind break for the upper regions of wind shield 10. The combination is a relatively windfree and stable wind shield structure.

Figure 7:
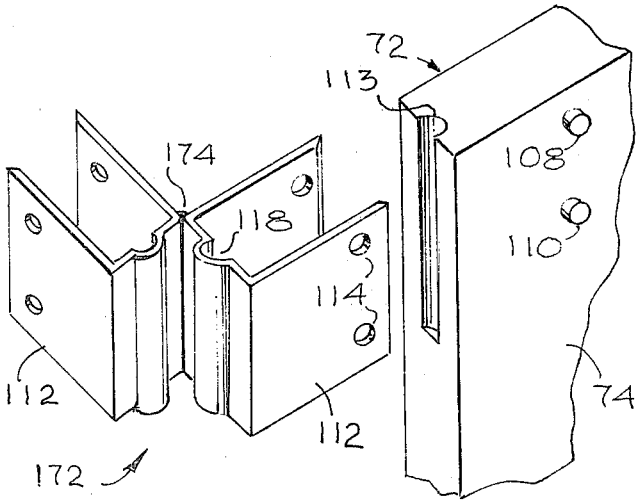
FIG. 7 is an orthogonal representation of a coupling method for use with the end panels of FIGS. 4, 5, and 6, according to my invention.

In FIG. 7 special closure coupler 172 comprises a pair of umbrella end couplers 112 joined by means of a plastic bonding material or cement along one of the edges 174. Such bonding material should exhibit flexibility. The openings 114 in the umbrella end couplers are spaced and dimensioned to cooperate with elements 108 and 110 on frame 74 of each of the end panels 72 which are to be joined. The closure is thus completed and, if desired, the panes in panel 72 may be opaque so that the resulting structure may be used as a dressing room. With end couplers 112 in place an aperture, half of which is shown at 113, is formed with each frame 74 to receive an umbrella stay.

Figure 8:
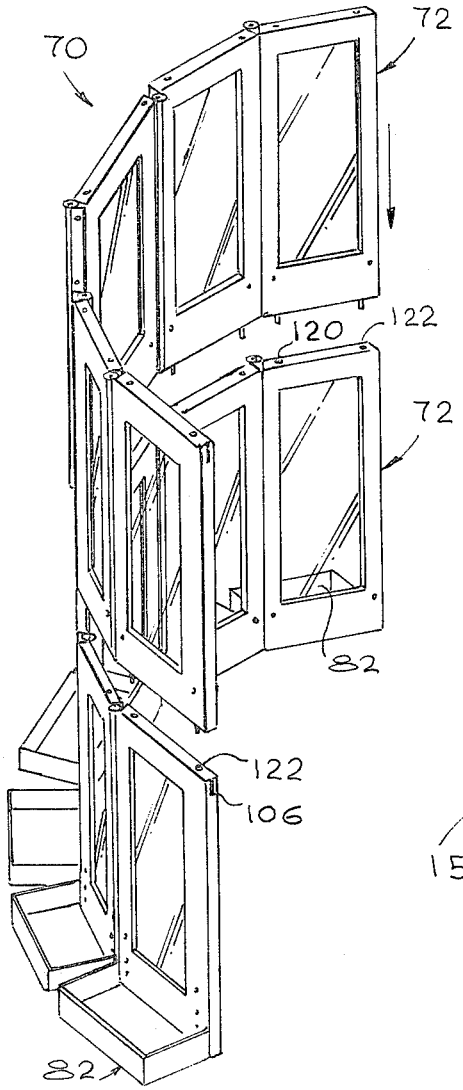
FIG. 8 shows an extension of the invention contained in FIGS. 4, 5 and 6, according to my invention.
Figure 9:
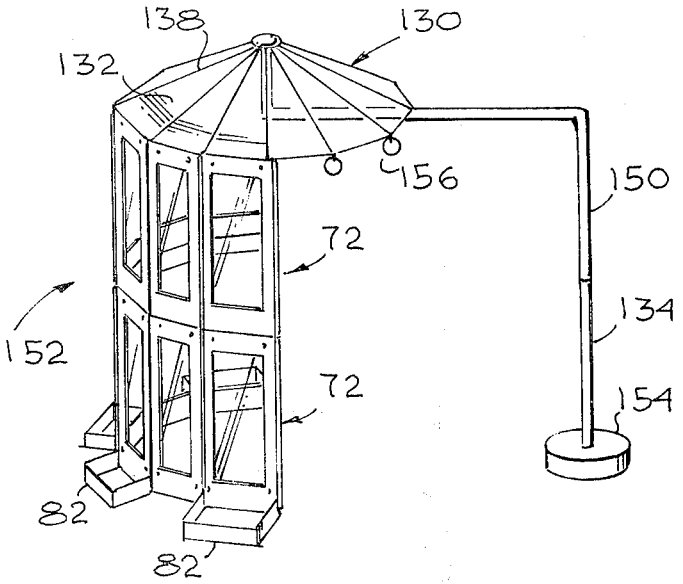
FIG. 9 shows an extension of the wind shelter concept included in FIG. 8.

It may be desirable to provide a wind shield structure which is sufficiently tall to permit a fully grown man to stand and still be sheltered. Such an end is achieved by the structure of FIG. 8 in which panels 72 have been stacked. Each panel 72 has in its lower extremity a protrusion or nipple which is designed to cooperate with a receptacle, such as receptacle 120 or 122 shown in FIG. 5, in the lower panel 72. This structure snaps together in a simple fashion and provides additional wind protection. Appropriate ballasts are provided, which, in this case, because of the increased wind-resistant area, should be of a greater mass than that which would be required for a single-panel-high structure. Further stability and shelter from the wind can be achieved by adding the umbrella structure to the two-panel-high structure, as shown in FIG. 9. Each of the panels 72 has, as shown in FIGS. 5 and 6A, a receptacle, 106, for the tip of the stay or supporting element 138 of the shelter portion 132 of umbrella 130. An extension 150 in supporting pole 134 is required to accommodate the increased height of wind shield 152. Ballast container 154 should also be of a greater size or increased in number in the windward direction to counteract the increased wind pressures which can be expected when this wind shield of increased area is exposed to the wind.

Colorful balls 156 may be attached to the ends of those umbrella stays 138 which are not required for connection with the panel 72 making up wind shield 152. These colorful balls (which may be packaged in the umbrella container) while adding aesthetically to the wind shield structure also have the very practical purpose of preventing the user of the wind shield structure from accidentally striking one of the exposed ends with his eye.

Figure 10:
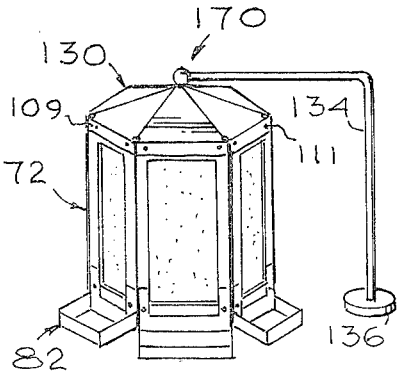
FIG. 10 is a schematic representation of an extension of my invention to a closed structure.

While the wind shelters of FIGS. 1 thru 9 only partially enclose the user, it is possible to extend the concepts of FIGS. 1 thru 9 to a fully enclosed structure, more commonly thought of as a cabana. Such a structure is shown in FIG. 10 and what is required to complete the enclosure 170 of FIG. 10 is a special coupling member which is shown as element 172 in FIG. 7.

Figure 11:
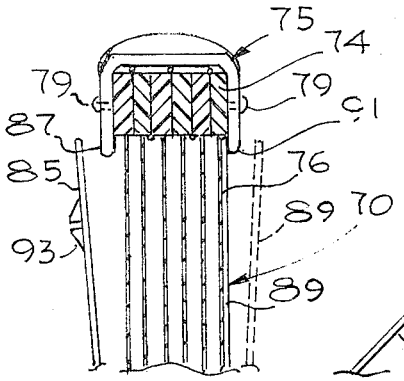
FIG. 11 is an end view partially schematic and partially cut-away, of a wind shelter according to this invention collapsed for transportation; and, FIG. 12 is a schematic diagram of an additional feature of my invention.

The wind shield or screen 20 of FIG. 4, by reason of its hinges 77 can be folded into a compact package, as shown in FIG. 11. Each of panels 72 carries a pane 76. Wind screen 70 is held in its folded condition by yoke 75 which straddles the folded wind screen and is secured in position by buttons 79. The outermost panes 76 are protected from damage in transit by plastic panels 85, 89. Panels 85, 89 are resilient and may be inserted under tabs 87, 91 which are extensions of yoke 75, to secure the panels in a protective position. There may be tabs on opposite frame members 74.

Figure 12:
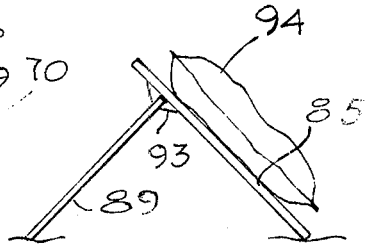

Panel 85 has a bracket 93 thereon and, in combination with panel 89 forms the back rest shown in FIG. 12. A pillow 94 may be provided for comfort.

Thus it can be seen that there have been provided several embodiments of a unique wind shelter structure which permits easy assembly, dis-assembly and transportation to any site where it is to be used. The use of the detachable ballast containers is particularly novel and the novelty is taken one step further when the ballast containers are used as the end caps, as in FIGS. 1 thru 3. Also, the inter-coupling of the umbrella structure to the wind shield structure results in a highly stable and draft free structure for use at the beach or any other environment where shelter from the wind is desired.

While particular embodiments of my invention have been shown and described, it will be apparent to those skilled in the art that variations and modifications may be made therein without departing from spirit or scope of the invention. It is the intention of the appended claims to cover all such variations and modifications.

I claim:

1. A wind shield having at least one frame portion and a pane portion carried within said at least one frame portion, said frame portion having an upper and a lower member joined by side members;

at least one ballast container having a back portion, said back portion having at least one securing aperture therein;

a securing button carried in said lower member of said frame portion and protruding therefrom;

said at least one securing aperture being dimensioned to cooperate with said securing button for easy application and removal of said ballast container to and from said lower member of said at least one frame portion;

said frame portion being flexible along its upper and lower members and said pane portion being flexible whereby said wind shield may be rolled about an axis normal to said upper and lower members of said frame portion;

said wind shield including, in addition, a tube, having a length adequate to receive said wind shield, the number of said ballast containers is at least two and such ballast containers are shaped and dimensioned to form end caps for said tube.

* * * * *